US005890293A

United States Patent [19]

Gamba

[11] Patent Number: 5,890,293

[45] Date of Patent: Apr. 6, 1999

[54] CUTTING TOOL HAVING BLADE HOLDER ASSEMBLY

[76] Inventor: Gregory G. Gamba, 4 Locust Pl., Livingston, N.J. 07039

[21] Appl. No.: 531,933

[22] Filed: Sep. 21, 1995

[51] Int. Cl.[6] ..... B26B 1/08

[52] U.S. Cl. ..... 30/125; 30/162

[58] Field of Search ..... 30/125, 162, 260, 30/332, 333; 229/44

[56] References Cited

U.S. PATENT DOCUMENTS

| | | | |
|---|---|---|---|
| 830,451 | 9/1906 | Peterson | 30/169 X |
| 2,094,260 | 9/1937 | Brody | 30/162 |
| 4,381,604 | 5/1983 | Horst | 30/169 |
| 5,093,994 | 3/1992 | Karas | 30/125 |

*Primary Examiner*—Douglas D. Watts
*Attorney, Agent, or Firm*—Lerner, David, Littenberg, Krumholz & Mentlik

[57] ABSTRACT

A cutting tool is constructed from a rigid, U-shaped frame member which supports a pivotable blade holder assembly. The blade holder assembly is operative for clamping a replaceable utility blade to the frame member by means of an easily engageable bolt. A retractable safety cover prevents accidental injury from contact with the cutting blade, while a removable sleeve defines a storage area in conjunction with the frame member for storing one or more replaceable cutting blades.

30 Claims, 6 Drawing Sheets

CUTTING TOOL HAVING BLADE HOLDER ASSEMBLY

FIELD OF THE INVENTION

The present invention relates in general to cutting tools, and more particularly, to utility knives, flush cutters and the like having a blade holder assembly operative to enable ready replacement of a worn or broken blade, while at the same time, securing the blade within the cutting tool to enable the use thereof in a variety of cutting operations.

BACKGROUND OF THE INVENTION

Cutting tools are widely used to perform many different functions. For example, cutting tools are used to cut hair, clothing, electrical wire, paper, flowers, tree branches, wood products, metal products, carpeting, food, etc. In order to increase cutting performance, the cutting tool art has become highly specialized so that a different type of cutting tool may be used to best perform each of the above mentioned cutting operations. More particularly, a standard garden shears may be used to cut tree branches, prune plants or cut flowers. A scissors may be used for ordinary cutting operations while scissors having a more precision type blade may be used to cut hair or clothing.

There is also known a variety of cutting tools which include a replaceable cutting blade, for example, utility knives used by contractors for various trimming operations and a flush cutter as disclosed in Applicant's copending application Ser. No. 304,889 entitled, "Flushcutter" filed on Sep. 13, 1994. Common in each of these aforementioned cutting tools is a blade holder assembly operative to enable attachment of the cutting blade to the handle to enable use of the cutting tool, while at the same time, enabling ready removal of the cutting blade when the need for replacement arises, e.g., when the blade becomes worn or broken. In this regard, a blade holder assembly must satisfy two competing objectives, i.e., securing the cutting blade for use while enabling its ready replacement. Although there is known blade holder assemblies which attempt to meet each of these objectives, they typically do not achieve both objectives equally well.

In addition to the foregoing requirements for the blade holder assembly, the cutting tool should be constructed from one or more frame members of sufficient rigidity to enable use of the cutting tool for its intended purpose. To this end, known cutting tools have been constructed from rigid and heavy metal frame members in order to meet this need. This can result in the cutting tool being heavy, bulky to hold, and often expensive to manufacture. There is accordingly an unsolved need for a cutting tool which is constructed from one or more lightweight frame members of sufficient rigidity to meet the demands of the use of these cutting tools in a variety of applications, such as those noted hereinabove.

SUMMARY OF THE INVENTION

It is broadly an object of the present invention to provide a cutting tool having a blade holder assembly which equally satisfies the need of securing the cutting blade, while at the same time, allowing the cutting blade to be readily removed for replacement.

Another object of the present invention is to provide a cutting tool having a blade holder assembly which is operative using one's fingers, a conventional screw driver, coin edge or the like to permit blade attachment and replacement.

Another object of the present invention is to provide a cutting tool having a blade holder assembly which enables storage of replacement blades for ready use.

Another object of the present invention is to provide a cutting tool having a blade holder assembly which is inexpensive to manufacture from the fewest number of components.

Another object of the present invention is to provide a cutting tool constructed from rigid framelike members, for example, U-shaped members and the like.

In accordance with one embodiment of the present invention there is described a cutting tool comprising a frame member, a cutting blade removably supported on the frame member, a plate coupled to the frame member arranged overlying at least a portion of the blade, and securing means in operative association with the plate for releasably clamping the blade against the frame member by engagement of at least a portion of the plate with the blade, whereby the blade can be replaced upon release thereof by operation of the securing means.

In accordance with another embodiment of the present invention there is described a cutting tool comprising at least one U-shaped frame member, a cutting blade removably supported on the frame member, a plate pivotably coupled to the frame member overlying at least a portion of the blade, a bolt threadably received through one end of the plate for releasably clamping the blade against the frame member, the bolt having a portion thereof engaging the blade while pivoting the plate such that another end of the plate engages the blade thereby clamping the blade to the frame.

In accordance with another embodiment of the present invention there is described a cutting tool comprising a frame member, a cutting blade attached to the frame member, and a protective cover slidably retained on the frame member, the protective cover movable between a safety position overlying a cutting edge of the blade and a user position whereby the cutting edge is exposed for use.

In accordance with another embodiment of the present invention there is described a cutting tool comprising a U-shaped frame member having a base and a pair of spaced apart legs, a cutting blade supported on the base between the spaced apart legs, and securing means for releasably securing the blade to the base.

In accordance with another embodiment of the present invention there is described a cutting tool comprising a frame member, a cutting blade removably attached to the frame member, a sleeve member slidably received over a portion of the frame member, at least one extra cutting blade removably supported on the frame member underlying the sleeve member, whereby the extra cutting blade is removable upon sliding the sleeve member away therefrom along the frame member.

BRIEF DESCRIPTION OF THE DRAWINGS

The above description, as well as further objects, features and advantages of the present invention will be more fully understood with reference to the following detailed description of a cutting tool having a blade holder assembly, when taken in conjunction with the accompanying drawings, wherein.

DETAILED DESCRIPTION OF THE PREFERRED EMBODIMENTS

Figure 1:
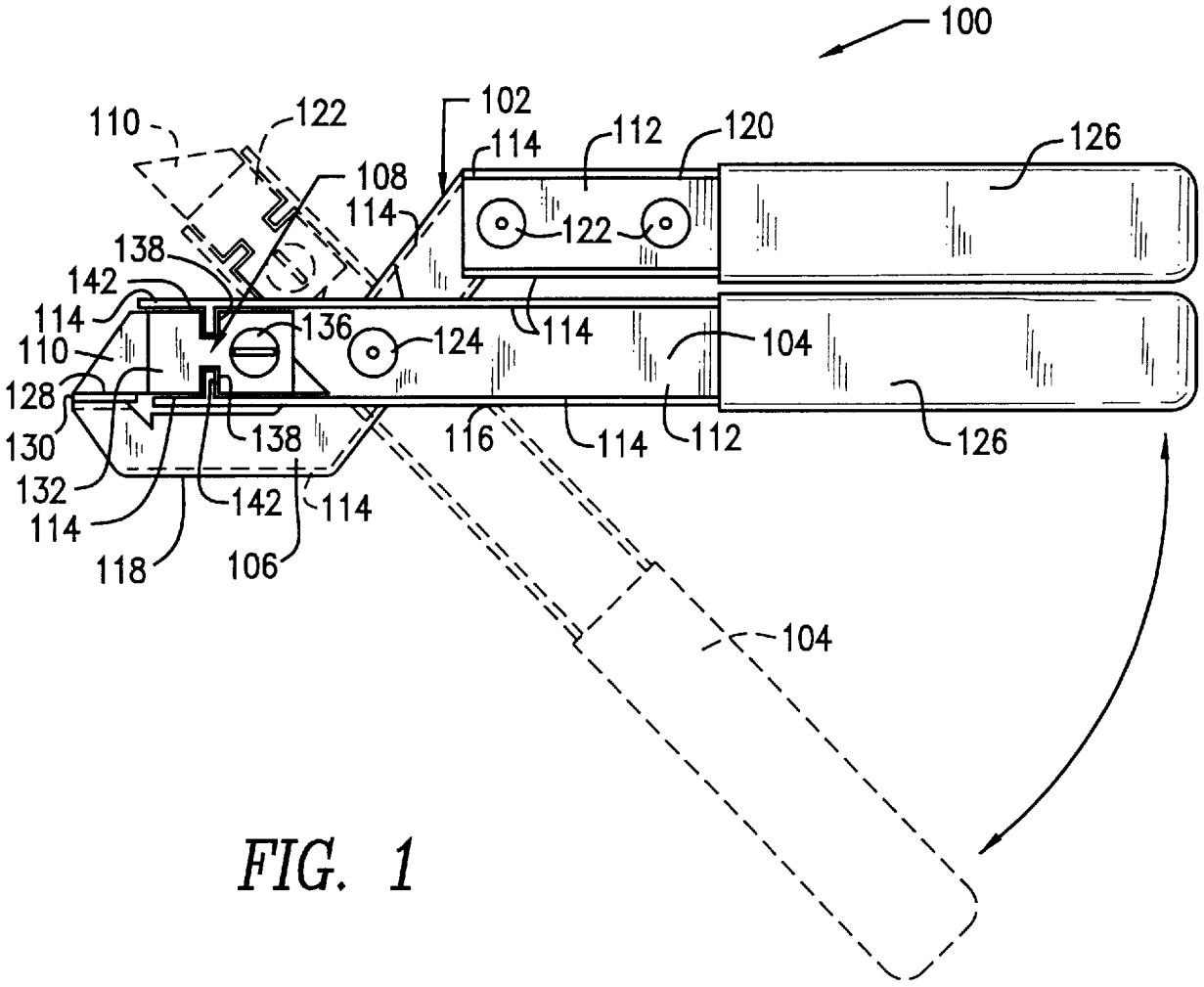
FIG. 1 is a front elevational view illustrating a cutting tool in the nature of a flush cutter having a blade holder assembly constructed in accordance with one embodiment of the present invention.

Turning now to the drawings, wherein like reference numerals represent like elements, there is shown in FIG. 1 a cutting tool generally designated by reference numeral 100 in the nature of a flush cutter of the type disclosed in the aforementioned application. The cutting tool 100 is generally constructed of three basic components, a frame assembly 102 which includes a first frame member 104 and a second frame member 106, a blade holder assembly 108 and a cutting blade 110. The frame members 104, 106 are each constructed from an elongated U-shaped member having a base 112 and a pair of spaced apart legs 114. As a U-shaped member, the frame members 104, 106 are provided with sufficient rigidity and mechanical strength to be useful for the construction of the cutting tool 100, while at the same time, being light in weight.

As shown in accordance with one embodiment, the first frame member 104 is constructed as a single elongated U-shaped member 116, while the second frame member 106 is constructed from a pair of U-shaped members 118, 120 joined back-to-back by means of a plurality of spaced apart rivets 122, or other such suitable means such as screws, bolts, spot welding and the like. It is, however, to be understood that the second frame member 106 may be constructed from a single U-shaped member by bending same at the appropriate locations, and contrary, the first frame member 104 may be constructed from a plurality of joined U-shaped members.

Figure 3:
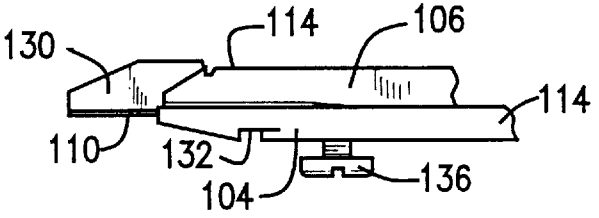
FIG. 3 is a partial top plan view of a flush cutter showing the blade holder assembly constructed in accordance with the present invention.

The frame members 104, 106 are pivotably joined together in back-to-back relationship by a rivet 124, pin, or other such suitable means to enable pivoting of the frame members relative to one another. One end of the frame members 104, 106 is provided with a polymeric sleeve 126 which, in part, defines a handle portion for engagement by the user of the cutting tool 100 so as to manipulate pivotable motion between the frame members 104, 106. The other end of frame member 104 supports a cutting blade 110 which may be of the conventional utility knife type which is readily available. The cutting blade 110 is slidingly received between legs 114 overlying the base 112 of frame number 104. The forward end of the cutting blade 110 extends beyond the frame member 104 so as to expose its lower cutting edge 128. The cutting edge 128 engages an opposing flat anvil 130 (see also FIG. 3) formed from a folded over portion of an extended leg 114 of frame member 106. The anvil 130 provides a cutting surface which is engaged by the cutting edge 128 of the cutting blade 110 upon pivotable manipulation of the frame members 104, 106 during use of the cutting tool 100.

Figure 2:
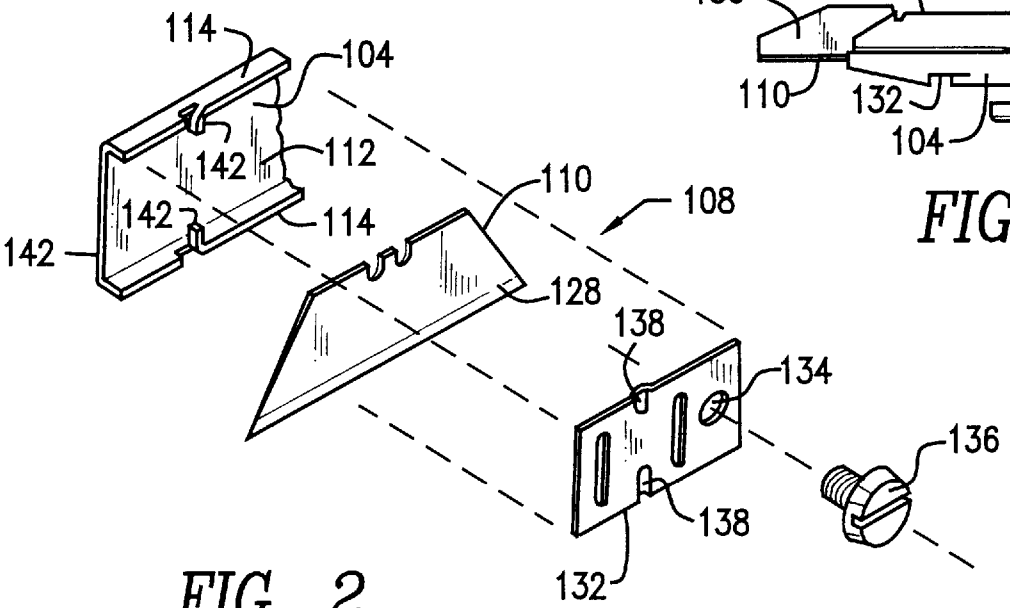
FIG. 2 is an exploded perspective unassembled view of the construction of the blade holder assembly in accordance with the present invention.
Figure 4:
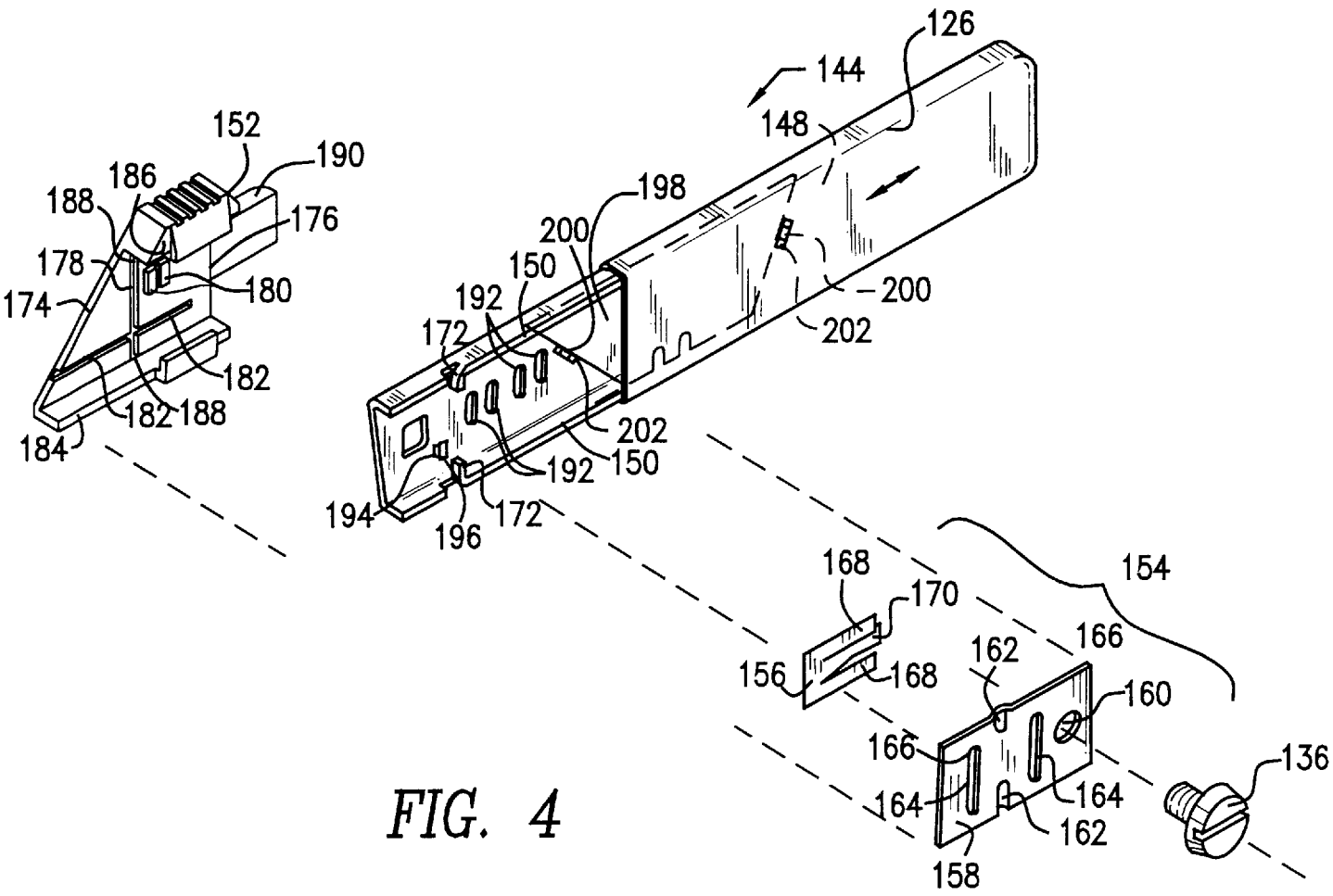
FIG. 4 is exploded perspective unassembled view of a utility knife having a blade holder assembly constructed in accordance with another embodiment of the present invention.

Referring to FIG. 2, the construction of the blade holder assembly 108 is shown in greater detail. The blade holder assembly includes a generally flat rectangular plate 132 sized in width to be received between the spaced apart leg 114 of the frame member 104. The plate 132 is provided with a threaded opening 134 adjacent one end thereof so as to threadingly receive a threaded bolt 136, screw or the like.

Generally within a central portion of the plate 132, a pair of aligned opposing indents 138 are provided extending inwardly from the outer edges of the plate. The plate 132 is received overlying the base 112 adjacent the forward end 140 of the frame member 104. A pair of spaced apart opposing pins 142 are formed by inwardly bending a cutout portion of the legs 114 of the frame member 104. The plate 132 is slid overlying the base 112 and underlying the pins 142 until they are received within the indents 138 to enable the plate to pivot thereabout. The cutting blade 110 may be slidingly received between the plate 132 and the base 112 of the frame member 104. The cutting blade 110 is positioned to provide a portion thereof extending outwardly beyond the forward end 140 of the frame member 104 to expose the cutting edge 128.

The cutting blade 110 is clamped between the plate 132 and frame member 104 by threading the bolt 136 through the threaded opening 134 into engagement with a portion of the blade. As the bolt 136 is rotated, its free end will engage the cutting blade 110 causing the plate to pivot about pins 142 until the opposite end of the plate also engages the cutting blade. At this point, further rotation of the bolt 136 will press the underlying portion of the cutting blade firmly against the base 112 of the frame member 104. Simultaneously, the pivoting action of the plate 132 will press the other end of the plate against another portion of the cutting blade 110 so as to securely clamp the cutting blade to the frame member 104. By rotation of the bolt 136 within the threaded opening 134, the plate 132 is operative for releasably securing the cutting blade 110 to the frame member 104. In this regard, it is to be understood that the greater the distance between the indents 138 and threaded opening 134 will increase the mechanical advantage which can be applied by the bolt 136 to increase the engagement pressure of the other end of the plate against the cutting blade.

The bolt 136 may be of sufficient size to be rotated by one's fingers, a conventional screw driver, coin edge or the like. The cutting blade 110 may be easily removed from the cutting tool 100 by loosening bolt 136 thereby eliminating the clamping action of the plate 132. Although the bolt 136 has been described as acting upon a portion of the cutting blade 110, depending upon the size and shape of the blade, it is possible that the bolt will engage only the base 112 of the frame member 104. In this regard, the bolt 136 will still pivot the plate 132 such that its other end engages a portion of the cutting blade 110 so as to clamp the cutting blade in a secured position.

Referring now to FIGS. 4–7, there is disclosed a cutting tool 144 in the nature of a utility knife constructed in accordance with another embodiment of the present invention. With specific reference to FIG. 4, the cutting tool 144 is constructed generally from an elongated U-shaped frame member 146 formed from a base 148 having a pair of spaced apart legs 150, a retractable safety cover 152, a polymeric sleeve 126 and a blade holder assembly 154 which includes a plate-like spring 156, flat rectangular plate 158 and bolt 136. The blade holder assembly 154 differs over blade holder assembly 108 essentially by the addition of spring 156.

The plate 158 is provided with a threaded opening 160 operative for threadingly receiving bolt 136. A pair of aligned spaced apart indents 162 are formed within the central region of the plate 158 extending inwardly from the edges of the plate. A pair of spaced apart punched elongated openings 164 are formed so as to provide an adjacent elongated protruding detent extending from one side of the plate. The detents 166, one arranged on either side of the indents 162, provide an area for capturing and holding the spring 156. Other than the detents 166 formed by openings 164, the plate 158 is similar in construction to plate 132 of the blade holder assembly 108.

The spring 156 is constructed from a flat plate-like member having a pair of spaced apart legs 168 and an outwardly bent centrally disposed arm 170. The spring 156 is constructed from conventional spring-like materials such that arm 170 acts as a resilient spring lever arm to apply a compressive force in operative association with plate 158 as to be described. It is, however, to be understood that other shaped springs may be employed with the blade holder assembly 154 in accordance with the present invention.

Figure 5:
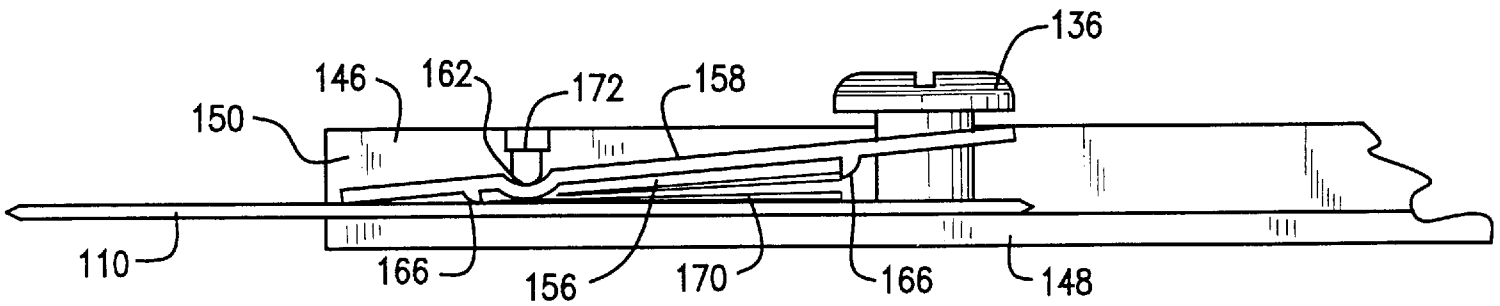
FIG. 5 is an assembled side elevational view of the blade holder assembly illustrated in FIG. 4.

The blade holder assembly 154 in assembled relationship is shown in FIG. 5. The plate 158 is pivotably coupled to the frame member 146 by pins 172, similar to pins 142, being received within the indents 162 of the plate. Spring 156 is initially positioned between the plate 158 and base 148 of the frame member 146. The spring 156 is held in position by being bound at either end by means of detents 166. Leg 170 of the spring 156 is operative for rotating the plate 158 in a counter-clockwise direction about the pins 172 such that threaded opening 160 remains spaced from base 148 of the frame member 146. The spring 156 effectively maintains cooperative engagement between indents 162 and pins 172 to prevent the plate 158 from falling out of the frame member 156 during replacement of the cutting blade 110. In this regard, it is to be understood that the spring 156 may also be incorporated within the blade holder assembly 108 as described with respect to the cutting tool 100. A cutting blade 110 is slid underlying the plate 158 between the base 148 of the frame member 146 and spring 156. The cutting blade 110 is secured by clamping same to the frame member 146 by operation of bolt 136 as previously described with respect to blade holder assembly 108. Accordingly, the specific operation of the blade holder assembly 154 will not be repeated hereat.

Referring once again to FIG. 4, there will now be described the construction of the retractable safety cover 152 which may be formed by molding from suitable polymeric material. The safety cover 152 is constructed from a base 174 having a resilient deflectable tab 176 formed by means of a U-shaped cutout 178. Projecting inwardly from the tab 176 is a pair of adjacent projecting segments 180. Extending along the inner surface of the base 174 is a groove 182 which extends also along tab 176 where it terminates adjacent one edge of the safety cover 152. The base 174 is laterally bound by a pair of sidewalls 184, 186 which have an inwardly turned projecting segment 188. A manually engageable release member 190 extends outwardly from the outer surface of tab 176 opposite to the projecting segments 180. Cooperating with the retractable safety cover 152, the base 148 of the frame member 146 is provided with pairs of spaced apart elongated openings 192 and a rearwardly projecting segment 194 formed adjacent opening 196.

Figure 6:
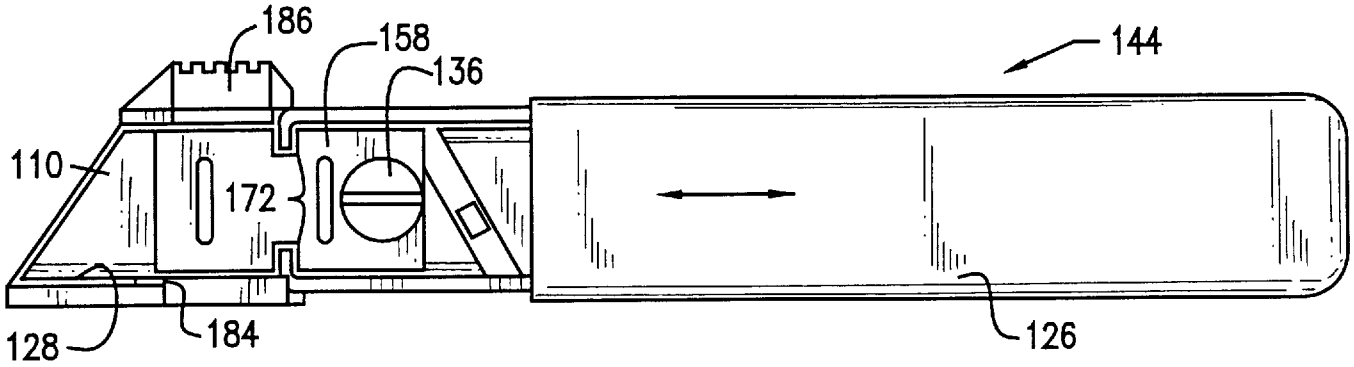
FIG. 6 is a front elevational view of the assembled utility knife shown in FIG. 4 having a retractable protective sleeve arranged in its safety position.
Figure 7:
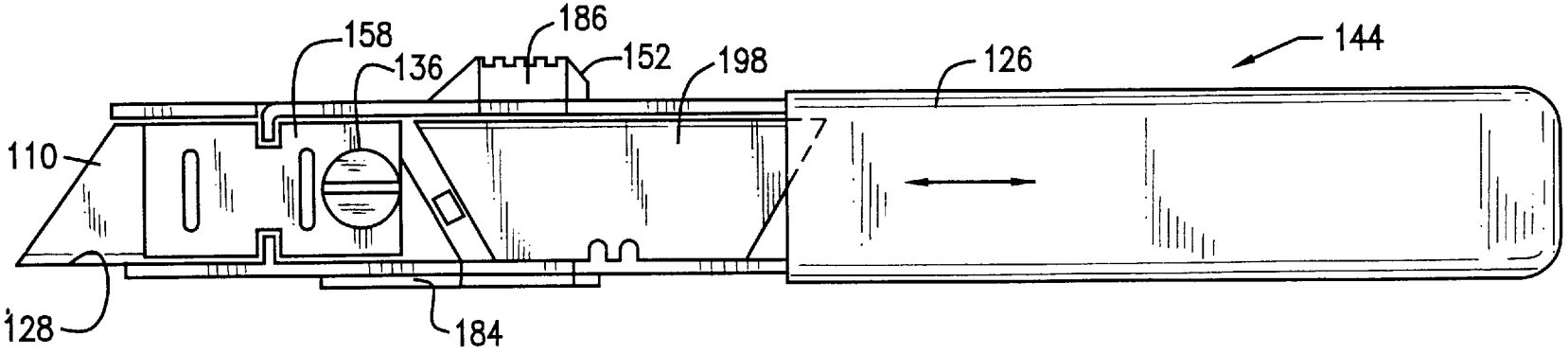
FIG. 7 is a front elevational view of the utility knife showing its protective sleeve arranged in a user position whereby the cutting edge of the blade is exposed for use.

Referring to FIGS. 6 and 7, the operation of the retractable safety cover 152 will now be described. The safety cover 152 captures overlying base 174 and between the sidewalls 184, 186 the end of the U-shaped frame member 146. Legs 150 of the frame member 146 are positioned adjacent the sidewalls 184, 186 with the segments 188 thereof projecting inwardly over the legs to slidingly secure the safety cover to the frame member 146. The projecting segment 194 is captured within groove 182 to act as a guide as the retractable safety cover 152 is slid along the frame member 146 between operative and inoperative positions.

As shown in FIG. 6, the safety cover 152 can be arranged in a safety position whereby the cutting edge 128 of the blade 110 is covered by sidewall 184. The safety cover 152 is maintained in this safety position by the projecting segments 180 on tab 176 being received within one set of openings 192. In order to retract the safety cover 152, it is first necessary to disengage the projecting segments 180 from within the openings 192. This is achieved by depressing release member 190 whereby the tab 176 is deflected away from base 148 of the frame member 146. Once the projecting segments 180 have been released from the openings 192, the safety cover 152 may be slid along the frame member 146 so as to expose the cutting edge 128 of the cutting blade 110 as shown in FIG. 7. In this regard, the safety cover 152 may be releasably locked in an open position by the projecting segments 180 engaging the other pair of openings 192 within the base 148 of the frame member 146. Although only two pairs of openings 192 are shown, any number of such openings may be provided. Accordingly, the retractable safety cover 152 provides a convenient and easily manipulated safety cover to prevent inadvertent contact with the cutting edge 128 of the blade 110 by the user during periods of non-use. The safety cover 152 is easily retracted by initial operation of the release member 190. Due to the resilient nature of the tab 176, the tab will return to its normal position on release of the release member 190 such that projecting segments 180 will be securely received within the desired openings 192.

Referring once again to FIG. 4, a polymeric sleeve 126 is slidably received over a portion of the U-shaped frame member 146 forming a handle portion. Within this portion, a plurality of extra cutting blades 198 may be stored. The extra blades 198 are maintained in lateral relationship within the U-shaped frame member 146 by being captured between a pair of inwardly extending projections 200 formed adjacent openings 202. The extra blades 198 are maintained within the confines of U-shaped frame member 146 by being covered by sleeve 126. In this regard, the sleeve 126 may be slid laterally along the frame member 146 to provide access to the storage area of the extra blades 198. Although not specifically described, a similar arrangement for storing extra blades 198 may be provided with the cutting tool 100.

Figure 9:
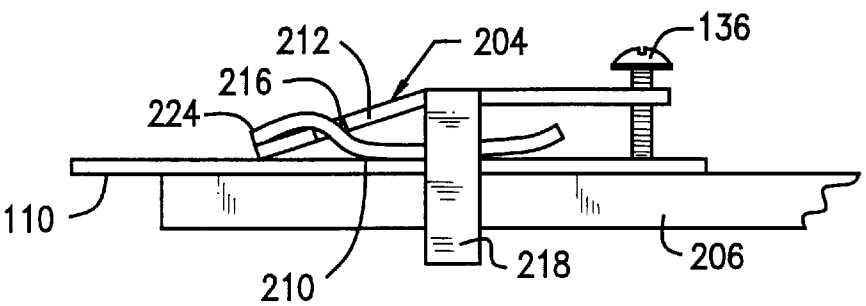
FIG. 9 is an assembled side elevational view of the blade holder assembly illustrated in FIG. 8.
Figure 8:
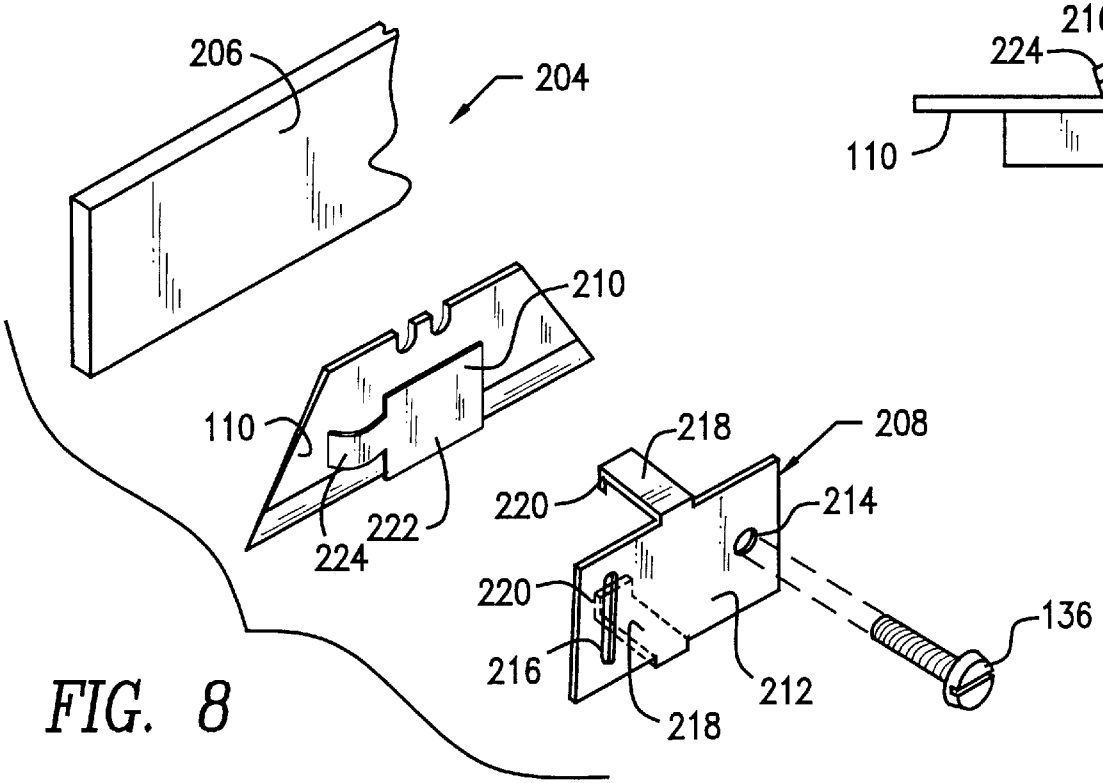
FIG. 8 is an exploded perspective unassembled view of the construction of a blade holder assembly in accordance with another embodiment of the present invention.

Referring now to FIGS. 8 and 9, there will be described another embodiment of a blade holder assembly constructed in accordance with the present invention and designated generally by reference numeral 204. The blade holder assembly 204 is particularly suitable for use with a cutting tool constructed to include a frame member 206 which has a rectangular cross section as opposed to the U-shaped frame members employed in the cutting tools 100, 144 as disclosed in FIGS. 1 and 4. In this regard, the frame member 206 is constructed of sufficient thickness so as to be useful for its intended purpose without additional reinforcement. The blade holder assembly 204 includes a pivotable plate member 208 and a spring 210. The plate member 208 includes a rectangular base 212 having a threaded opening 214 at one end thereof and an elongated opening 216 at the other end thereof. A pair of spaced apart L-shaped legs 218 are arranged extending outwardly from the opposite side edges of the base 212 at a generally central location thereof. The legs 218 are provided with inwardly turned flanges 220 opposing one another and providing an opening therebetween. The spring 210 is formed from a generally flat rectangular plate 222 from which there extends at one end a curved member 224.

Referring now to FIG. 9, the assembled relationship of the blade holder assembly 204 in securing a cutting blade 110 to the frame member 206 will now be described. Spring 210 is initially assembled to the plate member 208 by inserting the curved member 224 so as to extend through the elongated opening 216, with the plate 222 underlying the base 212 of the plate member. The plate member 208 is positioned overlying the frame member 206 such that the flanges 220 are received over the edges and engage the rear surface of the flange member 206. A cutting blade 110 is slid between the frame member 206 and spring 210. As previously described, as bolt 136 is rotated, its free end will clamp the cutting blade 110 directly to the frame member 206. At the same time, the operation of the bolt 136 will effect pivoting of the plate member 208 by virtue of legs 218 engaging the sides of the frame member 206 such that the other end of the plate member adjacent elongated opening 216 will engage and clamp the cutting blade 110 also to the frame member 206. It is to be understood that the spring 210 is also suitable for use in the blade holder assembly 108, 154.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A cutting tool comprising a frame member, a cutting blade removably supported on said frame member at a fixed location, a plate coupled to said frame member arranged overlying at least a portion of said blade, said plate pivotably coupled to said frame member about a Divot point arranged between the ends of said plate, a retractable cover slidably positioned over said frame member between a first and second position, said cover movable between a safety position overlying a cutting edge of said blade at said fixed location and a user position whereby said cutting edge is exposed for use at said fixed location, and securing means in operative association with said plate for releasably clamping said blade against said frame member by engagement of at least a portion of said plate with said blade, whereby said blade can be replaced upon release thereof by operation of said securing means.

2. The cutting tool of claim 1, wherein said securing means is arranged adjacent one end of said plate, said securing means having a portion thereof engaging said blade for clamping said blade thereat to said frame member while pivoting said plate for engaging another end of said plate with said blade for clamping said blade thereat to said frame member.

3. The cutting tool of claim 2, further including a spring arranged between said blade and said plate for pivoting said plate about said pivot point.

4. The cutting tool of claim 3, wherein said securing means comprises a bolt threadably received within said plate.

5. The cutting tool of claim 3, wherein said plate includes a pair of spaced apart detents, said detents maintaining the position of said spring therebetween.

6. A cutting tool comprising at least one U-shaped frame member, a cutting blade removably supported on said frame member, a plate pivotably coupled to said frame member overlying at least a portion of said blade, a spring arranged between said blade and said plate, and a bolt threadably received through one end of said plate for releasably clamping said blade against said frame member, said bolt having a portion thereof engaging said blade while pivoting said plate such that another end of said plate engages said blade thereby clamping said blade to said frame.

7. The cutting tool of claim 6, wherein said plate includes a pair of spaced apart detents, said detents maintaining the position of said spring therebetween.

8. The cutting tool of claim 6, further including a retractable cover slidably positioned over said frame member, said cover movable between a safety position overlying a cutting edge of said blade and a user position whereby said cutting edge is exposed for use.

9. The cutting tool of claim 6, wherein a portion of said frame member comprises a handle portion, a polymeric sleeve member slidable over said handle portion for enclosing said U-shaped member, and at least another cutting blade stored within said handle portion, said another cutting blade removable upon sliding said sleeve member away therefrom along said frame member.

10. A cutting tool comprising a frame member, a cutting blade, a pivotable plate supported on said frame member for attaching said cutting blade to said frame member at a fixed location, a spring arranged between said plate and said cutting blade, and a protective cover slidably retained on said frame member, said protective cover slidable between a safety position overlying a cutting edge of said blade at said fixed location and a user position whereby said cutting edge is exposed for use at said fixed location.

11. The cutting tool of claim 10, wherein said protective cover includes securing means for releasably securing said cover in said safety position.

12. The cutting tool of claim 10, wherein said cutting tool comprises a utility knife.

13. A cutting tool comprising an elongated U-shaped frame member having a base and a pair of spaced apart upstanding legs, a cutting blade supported on said base between said spaced apart legs, and securing means for releasably securing said blade to said base, a portion of said frame member comprises a handle portion, a sleeve member slidable over said handle portion for enclosing said U-shaped member, and at least another cutting blade stored within said handle portion, said another cutting blade removable upon sliding said sleeve member away therefrom along said frame member.

14. The cutting tool of claim 13, wherein said base includes at least a pair of pins retaining said at least another cutting blade.

15. The cutting tool of claim 13, further including a retractable cover slidably positioned over said frame member, said cover movable between a safety position overlying a cutting edge of said blade and a user position whereby said cutting edge is exposed for use.

16. A cutting tool comprising a frame member, a cutting blade removably attached to said frame member of polymeric material, a sleeve member slidably received along a portion of said frame member between an opened and closed position, at least one extra cutting blade removably supported on said frame member underlying said sleeve member when in said closed position, whereby said extra cutting blade is removable upon sliding said sleeve member away therefrom along said frame member to said opened position to provide access to said extra cutting blade.

17. The cutting tool of claim 16, wherein said frame member has a U-shaped cross section.

18. The cutting tool of claim 16, wherein said base includes at least a pair of pins retaining said at least one extra blade therebetween.

19. The cutting tool of claim 16, said frame member having a handle portion, and wherein said sleeve member overlies the handle portion of said frame member.

20. A cutting tool comprising a frame member, a cutting blade removably supported on said frame member, a plate coupled to said frame member arranged overlying at least a portion of said blade, said plate pivotably coupled to said frame member about a pivot point arranged between the ends of said plate, a spring arranged between said blade and said pate for pivoting said plate about said pivot point, and securing means arranged adjacent one end of said plate in operative association with said plate for releasably clamping said blade against said frame member by engagement of at least a portion of said plate with said blade, said securing means having a portion thereof engaging said blade for clamping said blade thereat to said frame member while pivoting said plate for engaging another end of said plate with said blade for clamping said blade threat to said frame member, whereby said blade can be replaced upon release thereof by operation of said securing means.

21. A cutting tool comprising at least one U-shaped frame member, a cutting blade removably supported on said frame member, a plate pivotably coupled to said frame member overlying at least a portion of said blade, a bolt threadably received through one end of said plate for releasably clamping said blade against said frame member, said bolt having a portion thereof engaging said blade while pivoting said plate such that another end of said plate engages said blade thereby clamping said blade to said frame, and a retractable cover slidably positioned over said frame member, said cover movable between a safety position overlying a cutting edge of said blade and a user position whereby said cutting edge is exposed for use.

22. A cutting tool comprising at least one U-shaped frame member, a cutting blade removably supported on said frame member, a plate pivotably coupled to said frame member overlying at least a portion of said blade, a bolt threadably received through one end of said plate for releasably clamping said blade against said frame member, said bolt having a portion thereof engaging said blade while pivoting said plate such that another end of said plate engages said blade thereby clamping said blade to said frame, a portion of said frame member comprising a handle portion, a polymeric sleeve member slidable over said handle portion for enclosing said U-shaped member, and at least another cutting blade stored within said handle portion, said another cutting blade removable upon sliding said sleeve member away therefrom along said frame member.

23. The cutting tool of claim 16, wherein said sleeve member is retained on said frame member when in said opened position.

24. A cutting tool comprising a frame member, a cutting blade removably attached to said frame member, a sleeve member slidably received along a portion of said frame member between an opened and closed position, at least one extra cutting blade removably supported on said frame member underlying said sleeve member when in said closed position, said base including at least a pair of pins retaining said at least one extra blade therebetween, whereby said extra cutting blade is removable upon sliding said sleeve member away therefrom along said frame member to said opened position to provide access to said extra cutting blade.

25. The cutting tool of claim 1, wherein said plate includes a pair of spaced apart legs engaging the sides of said frame member for pivotable movement therebetween.

26. The cutting tool of claim 25, wherein a portion of said frame member comprises a handle portion, a sleeve member slidable over said handle portion for enclosing said U-shaped member, and at least another cutting blade stored within said handle portion, said another cutting blade removable upon sliding said sleeve member away therefrom along said frame member.

27. The cutting tool of claim 1, further including another frame member having an anvil portion pivotably attached to said frame member, said anvil portion arranged for engagement with said cutting blade.

28. The cutting tool of claim 6, further including another frame member having an anvil portion pivotably attached to said frame member, said anvil portion arranged for engagement with said cutting blade.

29. The cutting tool of claim 13, further including another frame member having an anvil portion pivotably attached to said frame member, said anvil portion arranged for engagement with said cutting blade.

30. The cutting tool of claim 16, further including another frame member having an anvil portion pivotably attached to said frame member, said anvil portion arranged for engagement with said cutting blade.

* * * * *

UNITED STATES PATENT AND TRADEMARK OFFICE

CERTIFICATE OF CORRECTION

PATENT NO. : 5,890,293

DATED : April 6, 1999

INVENTOR(S) : Gamba

It is certified that error appears in the above-identified patent and that said Letters Patent is hereby corrected as shown below:

Column 1, line 29, after "Flushcutter" insert --,--.

Column 3, line 1, after "is" insert --an--.

Column 5, line 67, after "186" insert --of--.

Column 7, line 38, "Divot" should read --pivot--.

Column 8, line 42, "comprises" should read --comprising--.

Column 8, lines 57, 58, delete "of polymeric material".

Column 8, line 58, after "member" insert --of polymeric material--.

Signed and Sealed this

Seventh Day of September, 1999

*Attest:*

Q. TODD DICKINSON

*Attesting Officer*

*Acting Commissioner of Patents and Trademarks*